US010593307B1

(12) United States Patent
Lozano Martínez

(10) Patent No.: US 10,593,307 B1
(45) Date of Patent: Mar. 17, 2020

(54) RESONATOR FOR STRINGED MUSICAL INSTRUMENTS WITH A RESONANCE CHAMBER

(71) Applicant: José María Lozano Martínez, Madrid (ES)

(72) Inventor: José María Lozano Martínez, Madrid (ES)

(73) Assignee: José María Lozano Martínez (ES)

( * ) Notice: Subject to any disclaimer, the term of this patent is extended or adjusted under 35 U.S.C. 154(b) by 0 days.

(21) Appl. No.: 16/408,744

(22) Filed: May 10, 2019

(51) Int. Cl.
*G10D 3/02* (2006.01)

(52) U.S. Cl.
CPC ..... *G10D 3/02* (2013.01)

(58) Field of Classification Search
CPC ..... G10D 3/02
See application file for complete search history.

(56) References Cited

U.S. PATENT DOCUMENTS 1,777,070 A * 9/1930 Brann ..... G10D 3/02 84/294
2,370,460 A * 2/1945 Patmor ..... G10D 3/02 84/277
5,307,721 A * 5/1994 Ito ..... G10D 3/02 84/277
5,325,756 A * 7/1994 Sugden ..... G10D 3/02 84/276
7,259,308 B2 8/2007 Geiger
7,842,867 B2 11/2010 Schmidt
7,847,169 B2 * 12/2010 Umeda ..... G10D 3/02 84/267
7,863,507 B2 * 1/2011 Ayers ..... G10D 3/02 84/293
8,222,503 B2 * 7/2012 Aspri ..... G10D 3/02 84/294
10,276,135 B1 * 4/2019 Purol ..... G10D 1/08

FOREIGN PATENT DOCUMENTS

KR 20140062337 A 5/2014

OTHER PUBLICATIONS

Bellido, Nacho "La Guitarra Y Los Instrumentos De Cuerda Pulsados (The Guitar and the Plucked String Instruments)", Posted Dec. 13, 2011 [en linea][Recuperado el Jun. 7, 2017]. Recuperado de Internet (Downloaded from the Internet at): http://www.laguitarra-blog.com/2011/12/13/las-guitarras-resonadoras/ 7 pages.
Spanish Search Report for ES2685120B2 completed Jul. 6, 2017.

* cited by examiner

*Primary Examiner* — Robert W Horn
(74) *Attorney, Agent, or Firm* — Lerner, David, Littenberg, Krumholz & Mentlik, LLP

(57) ABSTRACT

A resonator for stringed musical instruments with a resonance chamber, is suitable for both bowed and plucked stringed instruments with a resonance chamber which aims at increasing the volume as well as the sound projection and timbre quality of the instrument, thus improving its performance, by eliminating the residual air which remains inside the sound box. For that purpose, the resonator comprises a tube with a beveled inlet end and an exit end with an end-button, one or more holes at various angles to reduce the air intake pressure, together with one or more compressor tubes included inside which interfere with the balance variation of air pressure and speed towards the exit across a reed.

8 Claims, 4 Drawing Sheets

A-A

A-A

B-B

RESONATOR FOR STRINGED MUSICAL INSTRUMENTS WITH A RESONANCE CHAMBER

FIELD OF THE INVENTION

This invention relates to a resonator for both bowed and plucked stringed musical instruments with a resonance chamber, including in an case their respective resonance chamber.

Aspects of the invention may provide the stringed musical instruments sector with a sound booster so as to achieve a greater sound clarity of the musical instrument and, in short, a top-quality timbre and a uniform sound projection.

BACKGROUND OF THE INVENTION

When a musical instrument, whether it is bowed or plucked, with a sound box or a resonance chamber, is played, the strings vibrate and transmit those vibrations to the resonance chamber, inside which airflow is produced due to the pressure variation determined by the strength applied to the strings.

So, the said airflow emerges as sound through the inherent holes of the instrument.

The problem lies in that inside the instrument remains a great amount of residual air which cannot get out through the holes and is blocked inside the sound box, thus producing turbulences and cramming which prevents the top and bottom plates of the instrument from wholly vibrating, thus reducing the production of harmonics.

Obviously, that restriction in harmonic production worsens to a great extent the ease of performance, the sound and timbre clarity, the volume, and the uniform sound protection.

BRIEF SUMMARY OF THE INVENTION

A resonator for stringed musical instruments with a resonance chamber, suitable for both bowed and plucked musical instruments, devised to be mounted on the center of the lower block of the instrument, it comprises an elongated tubular element, having one end fitted into an end-button, whereas on the other end, which serves as intake, it has a beveled cut, and also a number of holes along the tube; it is also devised to include one or more compressor tubes fitted into the main tube around the middle, and a reed working on a diffuser near the exit end.

BRIEF DESCRIPTION OF THE DRAWINGS

In order to complement the description of the present invention and with the object of helping comprehend its characteristics, in accordance with an example of preferable manufacturing of it, a set of diagrams is included, in which with the purpose of illustrating and never restricting, the following is shown.

DETAILED DESCRIPTION

Figure 1:
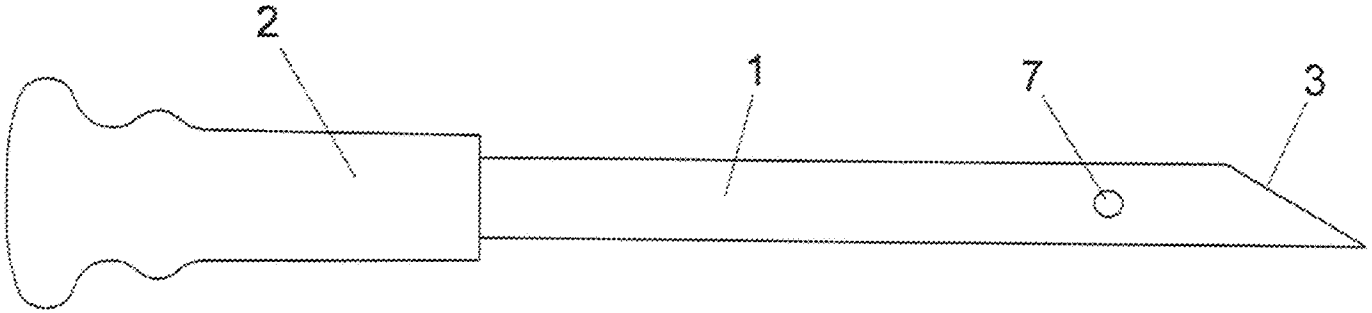
FIG. 1 illustrates a side view of a resonator for stringed musical instruments with a resonance chamber according to an embodiment of the invention.
Figure 2:
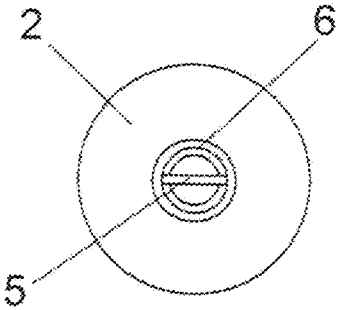
FIG. 2 illustrates the device depicted in the previous drawing from the end-bottom perspective.
Figure 3:
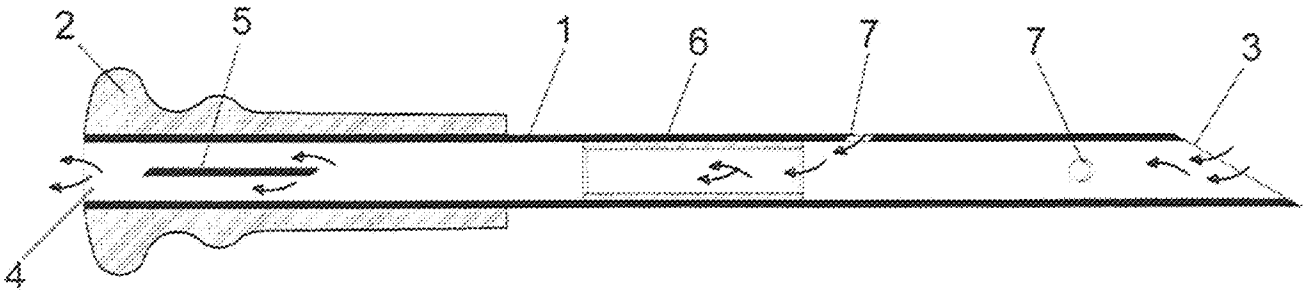
FIG. 3 illustrates a longitudinal section of the device depicted in the previous drawings according to the cut line A-A in FIG. 2.
Figure 4:
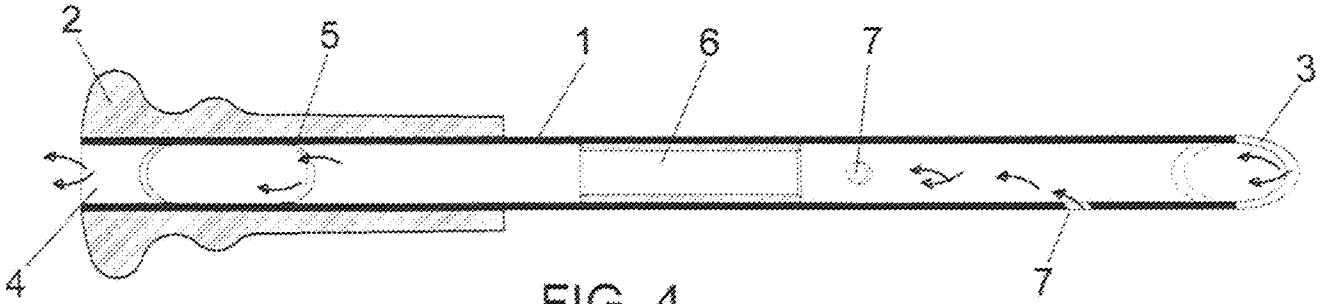
FIG. 4 illustrates a longitudinal section of the device depicted in the previous drawings according to the cut line B-B in FIG. 2.

The hereby presented resonator for stringed musical instruments with a resonance chamber totally resolves the previously stated question, and so being made of any type of organic or inorganic material, or a mixture of both, ranging from composites, fiberglass, carbon fiber, wood, glass, ceramic, plastic, metal, and alloys, is to be mounted on the back central part of the lower bout of the instrument, in other words, on the center of the lower block of the instrument, thus almost completely eliminating the residual air, facilitating to a great extent the solution to the aforementioned problem, since by using the resonator of the present invention, improvements in the volume, the sound projection, the timbre quality, the ease of performance, and the wolf tones reduction, or suppression, etc. are achieved.

More precisely, the resonator of the present invention, designed as a sound booster and a means of partly evacuating the residual air and correcting the harmonic production of stringed instruments, comprises an elongated small-sectioned tubular body, having one beveled end and the opposite one fitted into an end-button, including on this section a reed which works as a diffuser, so that the air gets in through the beveled end at high pressure and slow speed, whereas it gets out at a higher speed and lower pressure. For that reason, the tubular body presents a number of holes which may range from 2 to 20, at an angle from 90° to 30°, while the beveled end of the tube may range from 90° to 30°, whereas the opposite end will always be at an angle of 90°.

Inside the tube and concentric with it are one or more compressor tubes which interfere with the balance variation of pressure and speed, and so the resulting resonator is to be mounted inside a hole with the same diameter fitted into a standard musical instrument end-button.

The length of the tubular body may range between 5 and 700 mm, having a diameter between 2 and 50 mm, which depends on the acoustic and timbre characteristics of the musical instrument, and also on the technical and sound requirements of the performer (musician).

On the aforementioned diagrams, it may be observed that the resonator for stringed musical instruments with a resonance chamber comprises a tubular body or tube (1), made, as stated above, of any appropriate material, having on one end, and covering a section of it, an end button (2). The tube (1) has a beveled end (3) which may range from 90° to 30°, whereas the one with the end-button (2) has a 90° cut.

In the section (4) with the end button (2), the device includes a reed (5) which works as a diffuser for the controlled evacuation of the air.

Into the tube (1) are fitted one or more compressor tubes (6) which interfere with the balance variation of pressure and speed.

Also devised to be in the tube (1) is a number of holes (7) placed at an angle between them which may range from 90° to 30°.

All in all, once the resonator is mounted on the back central part of the lower bout of the instrument, in other words, on the center of the lower block of the instrument, the residual air which cannot normally go out through the instrument holes and is blocked inside the sound box, gets inside the tube (1) through its beveled end, gaining speed and losing pressure thanks to the holes (7) and the compressor tubes (6), passing through the diffuser constituted by the reed (5), and finally getting out through the opposite end (4), as stated previously, at a higher speed and lower pressure, avoiding the cramming formed by such air, and so allowing the complete vibration of the instrument plates and correcting the production of harmonics in that instrument.

Figure 5:
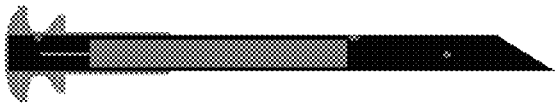
FIG. 5 illustrates a side view of a resonator with a multi-channel compressor tube according to an embodiment of the invention.
Figure 14A:
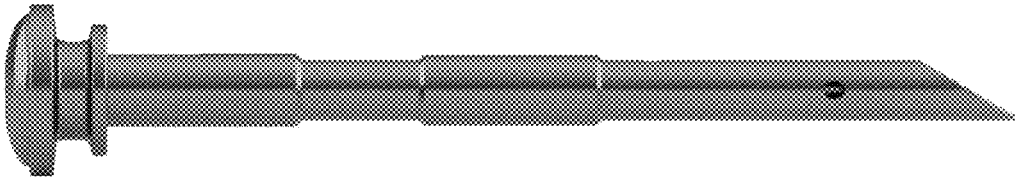
FIGS. 14A-14D illustrate a resonator and schematic cross-section views of a multi-channel compressor tube according to an embodiment of the invention.
Figure 14B:
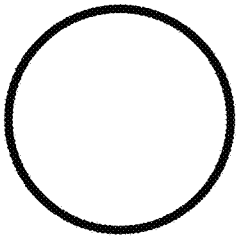
Figure 14C:
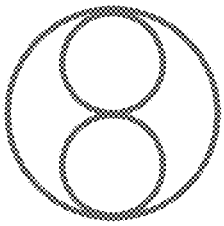
Figure 14D:
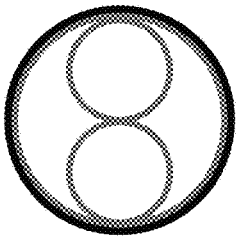

FIG. 5 illustrates a side view of a resonator with a multi-channel compressor tube (6') with copper and/or brass capillary tubes. An exemplary embodiment of the multi-channel compressor tube (6') is illustrated in FIGS. 14C and 14D. The multi-channel compressor tube (6') includes two capillary tubes (8) in the illustrated embodiment. It will be understood that other embodiments of the multi-channel compressor tubes may include more than two capillary tubes. In an embodiment, the capillary tubes (8) may be made of the same material as the compressor tube. In other embodiments, the capillary tubes may be made from a different material than that of the compressor tube.

Figure 6:
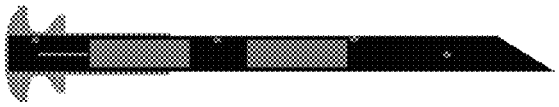
FIGS. 6-9 illustrate side views of a resonator with two compressor tubes according to various embodiments of the invention.

FIG. 6 illustrates a resonator with a first compressor tube (6) adjacent to the reed and a second compressor tube (16) spaced apart from the first compressor tube. In an exemplary embodiment, the first compressor tube is made of copper or brass and the second compressor tube is made of carbon fiber or some other such material.

Figure 7:
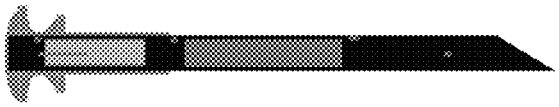

FIG. 7 illustrates a resonator with a first compressor tube (6) at least partially encompassing the reed and a second compressor tube (16) spaced apart from the first compressor tube (6). In an exemplary embodiment, the first compressor tube is made of brass with an interior and exterior finish with gold plating and the second compressor tube is made of carbon fiber or some other such material.

Figure 8:
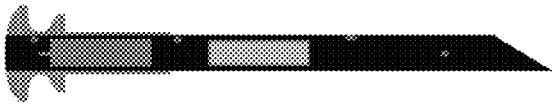

FIG. 8 illustrates a resonator with a first compressor tube (6) at least partially encompassing the reed and a second compressor tube (16) spaced apart from the first compressor tube. In an exemplary embodiment, the second compressor tube (16) is made of brass with an interior and exterior finish with gold plating and the first compressor tube (6) is made of carbon fiber or some other such material.

Figure 9:
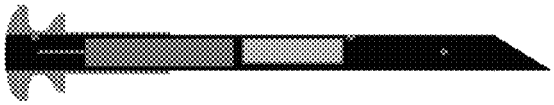

FIG. 9 illustrates a resonator with a first compressor tube (6) adjacent to the reed and a second compressor tube (16) spaced apart from the first compressor tube. In an exemplary embodiment, the second compressor tube (16) is made of brass with an interior and exterior finish with gold plating and the first compressor tube (6) is made of carbon fiber or some other such material.

Figure 10:
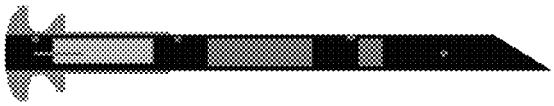
FIGS. 10-13 illustrate side view of a resonator with three compressor tubes according to various embodiments of the invention.

FIG. 10 illustrates a resonator similar to one illustrated in FIG. 7 and additionally includes a third compressor tube (26). In an exemplary embodiment, the third compressor tube (26) may be of the same material as that of the second compressor tube. In the illustrated embodiment, the third compressor tube (26) has a length shorter than the length of the second compressor tube.

Figure 11:
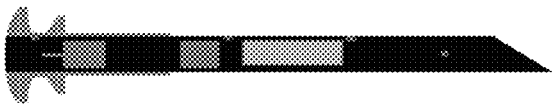

FIG. 11 illustrates a resonator similar to one illustrated in FIG. 8 and additionally includes a third compressor tube (26) arranged between the first compressor tube (6) and the second compressor tube (16). In an exemplary embodiment, the first compressor tube may be made of copper or brass, the second compressor tube is made of brass with gold plating on the interior and the exterior and the third compressor tube is made of carbon fiber or other such material.

Figure 12:
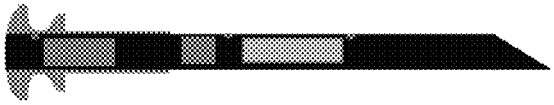

FIG. 12 illustrates a resonator similar to one illustrated in FIG. 11. However, in this illustrated embodiment, the reed is completely encompassed within the first compressor tube.

Figure 13:
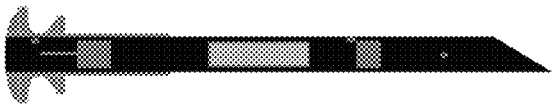

FIG. 13 illustrates a resonator to similar to one illustrated in FIG. 11. However, in this embodiment the third compressor tube (26) is arranged proximal to the intake end.

The invention claimed is:

1. A resonator for a stringed musical instrument with a resonance chamber, configured to be mounted on a center of a lower block of the stringed musical instrument, comprising:

an elongated tubular element, having an exit end fitted into an end-button, whereas on an intake end the elongated tubular element has a beveled cut, and a plurality of holes along the elongated tubular element;

one or more compressor tubes fitted into the elongated tubular element around a middle thereof; and a reed working on a diffuser near an exit end.

2. The resonator for stringed musical instrument with a resonance chamber, in accordance with claim 1, wherein the elongated tubular element has a length ranging between 5 and 700 mm, and a diameter between 2 and 50 mm.

3. The resonator for stringed musical instrument with a resonance chamber, in accordance with claim 1, wherein the elongated tubular element comprises a beveled end at an angle ranging between 90° to 30° at the intake end, and the exit end with a 90° cut.

4. The resonator for stringed musical instrument with a resonance chamber, in accordance with claim 1, wherein at least two or more of the plurality of the holes in the elongated tubular element are at an angle therebetween ranging from 90° to 30°.

5. The resonator for stringed musical instruments with a resonance chamber, in accordance with claim 1, wherein the elongated tubular element further comprises a compressor tube arranged therewithin.

6. The resonator for stringed musical instruments with a resonance chamber, in accordance with claim 5, wherein the compressor tube comprises a plurality of capillary tubes arranged therewithin.

7. The resonator for stringed musical instruments with a resonance chamber, in accordance with claim 1, wherein the elongated tubular element further comprises a plurality of compressor tubes arranged therewithin.

8. The resonator for stringed musical instruments with a resonance chamber, in accordance with claim 7, wherein each of the plurality of compressor tubes is spaced apart from an adjacent one of the plurality of compressor tubes.

* * * * *